US008127373B1

(12) United States Patent
Fodemski

(10) Patent No.: US 8,127,373 B1
(45) Date of Patent: Mar. 6, 2012

(54) PROTECTIVE HELMET HAVING A MICROPROCESSOR CONTROLLED RESPONSE TO IMPACT

(76) Inventor: Troy Allen Fodemski, Colorado Springs, CO (US)

( * ) Notice: Subject to any disclaimer, the term of this patent is extended or adjusted under 35 U.S.C. 154(b) by 0 days.

(21) Appl. No.: 13/189,298

(22) Filed: Jul. 22, 2011

(51) Int. Cl.
*A42B 3/00* (2006.01)

(52) U.S. Cl. ..... 2/413; 2/6.8; 2/411; 2/410

(58) Field of Classification Search ..... 2/410, 6.2, 2/6.8, 411, 412, 413, 414; 340/573.1; 280/728.1, 280/730.1
See application file for complete search history.

(56) References Cited

U.S. PATENT DOCUMENTS

| | | | | |
|---|---|---|---|---|
| 5,546,609 | A * | 8/1996 | Rush, III | 2/413 |
| 6,560,789 | B2 * | 5/2003 | Whalen et al. | 2/455 |
| 6,619,751 | B1 * | 9/2003 | Shah | 297/464 |
| 6,883,631 | B2 | 4/2005 | Hu et al. | |
| 7,017,195 | B2 * | 3/2006 | Buckman et al. | 2/455 |
| 7,150,048 | B2 * | 12/2006 | Buckman | 2/465 |
| 7,523,956 | B2 | 4/2009 | Zumpano | |
| 7,832,762 | B2 | 11/2010 | Breed | |
| 2009/0254003 | A1 * | 10/2009 | Buckman | 600/595 |

FOREIGN PATENT DOCUMENTS

| | | |
|---|---|---|
| EP | 0506696 | 10/1992 |
| GB | 226489 | 7/1990 |

* cited by examiner

*Primary Examiner* — Shaun R Hurley
*Assistant Examiner* — Andrew Sutton
(74) *Attorney, Agent, or Firm* — Hanes Hrbacek & Bartels LLC

(57) ABSTRACT

A method and system for reducing the concussive effects of impact. The system includes a helmet for protecting the head of a user. The helmet has a surface, an array of strain gauges attached on the surface for detecting an impact, an array of cells attached within the helmet and a fluid reservoir in fluid communication with the cells. Each cell is selectively inflatable to redirect impact forces to the shell of the helmet, and selectively deflatable to cushion a users head during impact. The process of inflation and deflation is enabled and optimized through the use of a microprocessor connected in operative communication with the array of strain gauges and with the valves. Accordingly, when the system detects impact, the microprocessor selectively signals at least some of the valves to rapidly change pressure in the cells near the impact.

20 Claims, 8 Drawing Sheets

PROTECTIVE HELMET HAVING A MICROPROCESSOR CONTROLLED RESPONSE TO IMPACT

FIELD OF THE INVENTION

This invention relates to helmets that protect users from impact, and particularly helmets that generate force responsive to impact to minimize adverse biomechanical and other effects of impact on the brain of a user.

BACKGROUND OF THE INVENTION

Concussive head trauma has been found to cause many degenerative brain diseases including chronic traumatic encephalopathy (CTE), a degenerative brain disease found in those who have a history of repetitive brain trauma, including concussions.

Individuals with Chronic Traumatic Encephalopathy may show symptoms of dementia, which includes memory loss, aggression, confusion and depression. Such symptoms may appear within months of the trauma or many decades later. CTE has been commonly found in professional athletes participating in contact sports such as gridiron football, ice hockey and professional wrestling. CTE may also result from motor vehicle collisions and battlefield injuries. Most CTE patients have experienced head trauma, resulting in the characteristic accumulation of tau protein and degeneration of brain tissue.

In recent years, professional sports organizations have taken an interest in protecting its players from concussive head trauma. In particular, the efficacy of common sporting equipment is being looked at. Better safety measures and safer helmets are being considered, particularly by the National Football League (NFL) and other professional sports organizations.

U.S. Patent Publication US2009/0265839 to Young et al. is an example of a helmet designed to protect individuals from concussive head trauma. The Young helmet includes a fluid safety liner of closed-cell foam that uses a series of channels and reservoirs to spread concussive forces through the use of viscous fluid flow within the helmet. Protection is afforded by using viscous fluid flow to redistribute peak force during impact. This reduces the biomechanical severity of the impact.

While Young et al. represents a step forward in the art, the mechanical nature of concussive trauma is complex and simple redistribution of impact forces may be insufficient to minimize the biomechanical severity of an impact. Better protection is desired.

The biomechanical effects of impact on the brain should be understood. Severe impact to the skull typically causes the brain to move within the skull. The brain may be pressed against the inside of the skull with sufficient force to damage the brain. Further, once this initial impact is completed, the brain may reverse direction (i.e. bounce), and hit the opposing inside of the skull, thus amplifying the probability of brain damage.

Simply redistributing impact forces as taught in Young et al. may be insufficient to prevent injury due to movement of the brain within the skull after an impact. What is desired is a way of further reducing brain trauma caused by an impact that will minimize harmful movement of the brain within the skull resulting from an impact.

SUMMARY OF THE INVENTION

The present invention detects external impact to the helmet and then produces responsive forces to counter this external impact. The purpose of countering the external impact is to prevent the brain from hitting the skull, or at least soften or slow such impact because it is known that rapid movement of the brain against the skull causes concussive trauma to the brain.

A feature of this system is to produce forces responsive to impact in a rapid and effective manner, which re-direct the forces associated with impact. In particular, the present invention provides a way of localizing the forces associated with impact on the shell of a helmet, which is particularly configured to dampen the impact forces.

The system includes a microprocessor that detects impact forces through a strain gauge array. In each strain gauge, current changes upon changes to the surface area affected by impact. This change to the surface area is a direct result of an external blow to the user's helmet.

One method of the present invention reduces concussive effects to the brain produced by impact on an outside surface of a protective helmet. The method includes sensing the magnitude and location of the impact, transmitting a first signal to the location of the impact, and in response to the first signal, adjusting fluid pressure in at least one cell disposed between the outside surface of the protective helmet and the head of the helmet wearer. In one embodiment of the invention, each cell is capable of rapid inflation, which inhibits penetration of the impact force into the head of a user, and instead, redirects the impact forces in the helmet shell. The redirected forces are localized primarily on the helmet shell and move through the shell like waves in a pool of water. Some of the waves meet at a point distant from the impact location.

The method further includes sequentially transmitting a second signal to a location on the helmet distant to the location of the impact, and in response to the second signal, adjusting fluid pressure at least one cell disposed between the outside surface of the protective helmet and the head of the helmet wearer at the location distant to the impact. This second phase of fluid pressure adjustment redirects the waves to assure that there is a minimal penetration of force inside the helmet, and instead the forces are localized to the shell of the helmet. In addition to redirecting forces to cause localization of forces on the helmet shell, the cells rapidly deflate to absorb any impact forces directed into the helmet. Deflating the cells also increases the time of impact, thus reducing the energy of impact, which is the traditional function of padding. Vents on the helmet dampen impact forces.

The method steps repeat as necessary to protect the helmet wearer from forces caused by impact.

A system of the present invention includes a helmet for reducing the concussive effects of impact. The helmet protects the head of a user by generating forces responsive to impact to optimize the protective capabilities of the helmet.

The helmet includes an array of strain gauges attached within the helmet for detecting a strain profile resulting from impact. The helmet also includes an array of inflatable cells attached within the helmet, where at least one of the cells is associated spatially with each strain gauge. The cells are selectively inflatable for absorbing and redistributing impact forces and for generating forces responsive to impact. The force responsive to impact may be generated by both instant pressurization of the cell and by expression of fluid from the cell during deflation of the cell. A fluid conduit and a valve are attached to each cell for regulating cell internal pressure. Cell inflation may be sequenced to optimal system performance.

The helmet includes an integrated microprocessor connected in operative communication with the array of strain gauges and with the valves that inflate and deflate the cells.

When the strain gauges detect impact, the strain gauges communicate strain measurements to the microprocessor. The microprocessor then selectively signals at least some of the valves to sequentially inflate and deflate the cells in response to the strain measurements.

Ideally the microprocessor determines an optimal impulse profile responsive to impact and causes the valves to inflate selected cells to match the optimal impulse profile. For example, upon detection of an impact, the microprocessor causes the valves to immediately inflate or deflate cells located near the impact. Also, the microprocessor after a predetermined delay period causes the valves to inflate or deflate cells at a location distant from the impact. In an alternate embodiment, the cells automatically deflate to a desired base pressure. Inflation and deflation of cells can be optimized to cushion a user's head during impact by redistribution of the impact forces and by cushioning the head.

DETAILED DESCRIPTION OF PREFERRED EMBODIMENT

Figure 1:
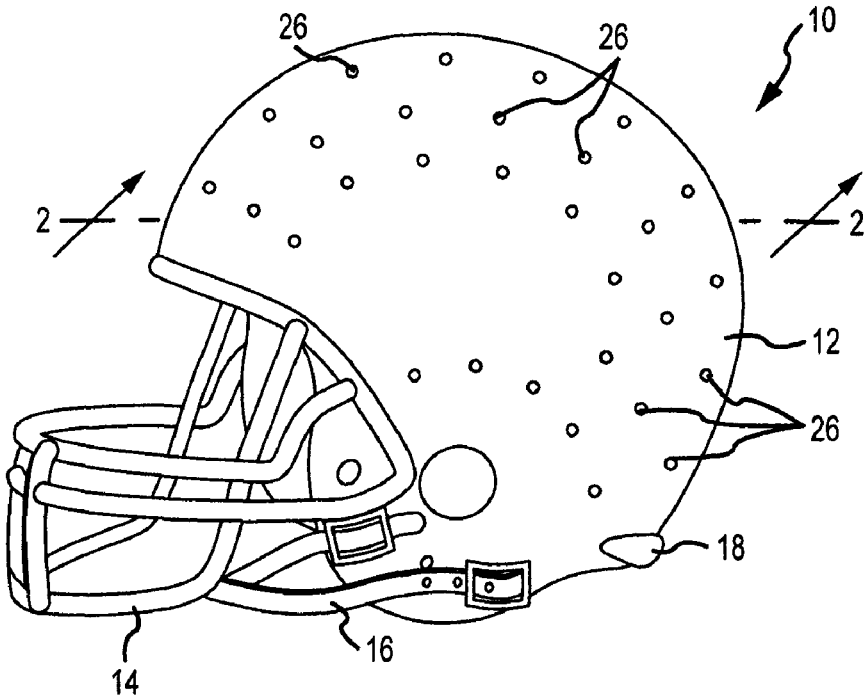
FIG. 1 shows a perspective view of a football helmet in accordance with the present invention.

FIG. 1 shows a helmet 10. The helmet 10 is a gridiron football (football) helmet including a shell 12, a mask 14 mounted on the shell 12, and a chin strap 16 for holding the helmet 10 on the head of a user. The shell 12 includes a plurality of vents 26 to enable compressed fluid to be expressed through the shell 12.

The helmet 10 includes a fluid reservoir 18 mounted on a rear portion of the helmet 10 opposing the location of the mask 14. Positioning the fluid reservoir 18 in a position opposing the mask 14 reduces the likelihood of impact directly against the reservoir 18. The reservoir 18 is refillable.

Figure 2:
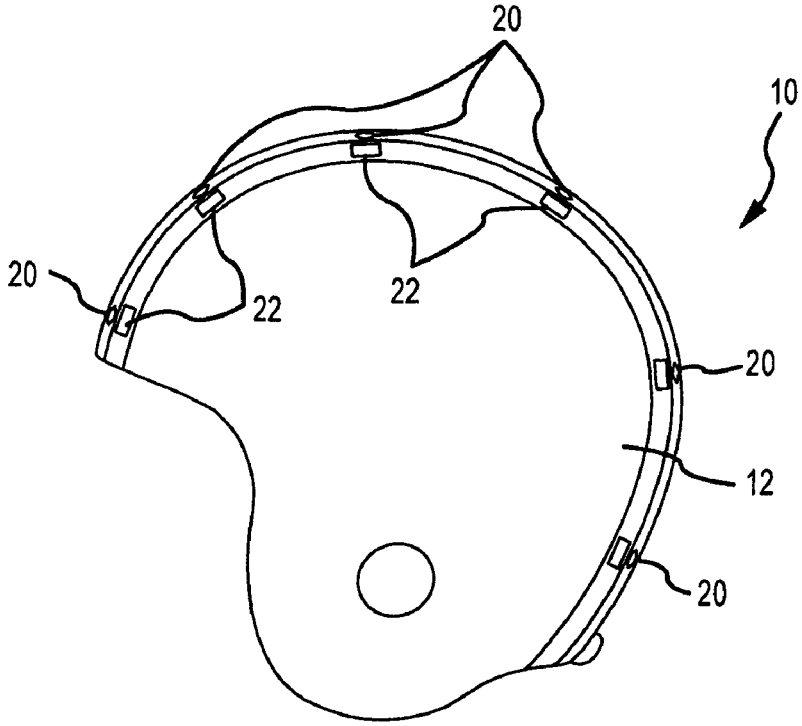
FIG. 2 shows a cross-sectional view of the football helmet of FIG. 1 as seen along the line 2-2.

FIG. 2 shows a cross-section of the helmet 10 as seen along the line 2-2 in FIG. 1 as seen in the direction of the arrows. The shell 12 includes an array of strain gauges 20 and an array of cells 22 mounted an inner surface of the shell 12. The array of strain gauges 20 and the array of cells 22 mount on the inner surface of the shell 12 to enable rapid replacement of the strain gauges 20 and the cells 22. The cells 22 are inflatable in response to impact to minimize the biomechanical effects of an impact on the brain of a user.

In an alternate embodiment, the strain gauges 20 and the cells 22 are integrated within the shell 12. The strain gauges 20 may be foil-type analog strain gauges, or digital strain gauges utilizing semiconductor materials.

A semiconductor strain gauge (piezoresistor) may be employed offering the benefit of higher gauge factor than an analog strain gauge, which is an alternative. In the case of a semiconductor strain gauge, a unique digital code is applied to each gauge. The unique digital code represents the region upon which the gauge is mounted and where associated cells are located.

Figure 3:
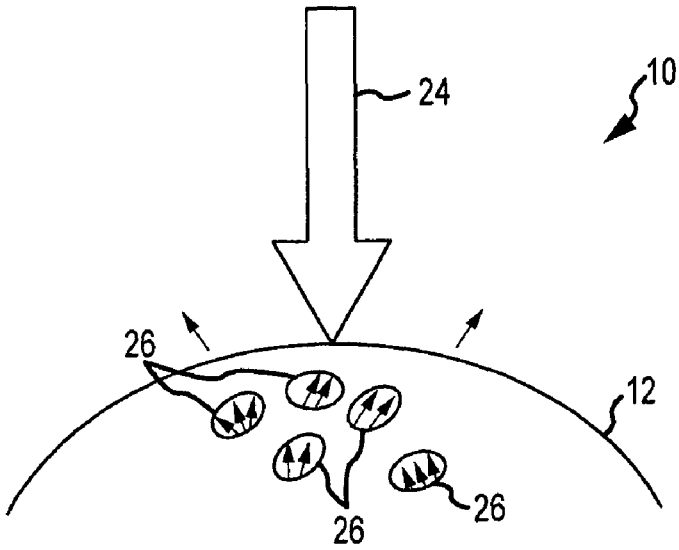
FIG. 3 shows an external force impacting a helmet.

FIG. 3 shows a portion of the helmet 10 undergoing an impact force 24 represented by the thick arrow. The shell 12 includes vents 26 associated with each cell (see FIG. 2). The vents 26 enable expression of fluid, preferably in gaseous form, from the helmet 10 to counter the impact force 24. The expressed fluid is ejected from the helmet 10 in a direction normal to the shell 12 surface in one embodiment of the invention. In another embodiment of the invention, the expressed fluid is directed in a direction opposing the impact force 24. It can be appreciated that the vents can be adapted to direct expressed fluid in any of a variety of directions. In one embodiment, each vent 26 aligns spatially with a corresponding cell underlying each vent 26. In one embodiment, the cells automatically vent at a predetermined pressure.

Figure 4:
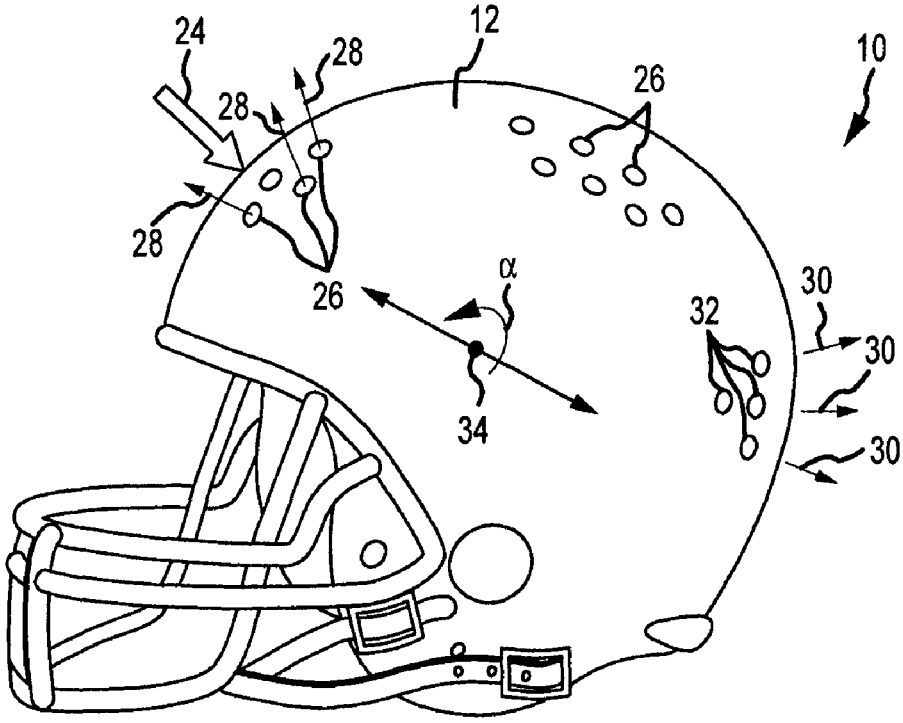
FIG. 4 shows the helmet generating a force responsive to impact.

FIG. 4 shows the helmet 10 undergoing an impact force 24. The impact force 24 hits the front portion of the helmet 10. At the front portion, near the region of impact, the vents 26 express fluid in response to the impact force 24 as shown by the arrows. The expression of fluid redirects impact forces and enables the cells to cushion the impact.

The helmet 10 has rear vents 32, the rear vents oppose the vents 26 located near the region of impact at approximately 180 degrees from impact. Particularly, the helmet 10 has a center 34 and the angle $\alpha$, which is 180 degrees as shown. In an alternate embodiment the angle $\alpha$ is between 90 degrees and 180 degrees. Often an impact on the front of the helmet 10 will result in shock waves on the shell of the helmet. The shock waves move radially from the point of impact in the shell and meet at a distant point, often at the rear of the helmet. One possibility is that that these waves will penetrate the helmet when they meet in the rear. To assure that the waves remain localized on the shell of the helmet, a second cell inflation at the rear of the helmet is utilized, and precisely timed to coincide with the meeting of the waves at the rear of the helmet.

Further, while a single set of rear vents 32 are shown, any of a number of sets of vents can be activated at various locations to counter the impact force 24. Such locations may be both in the region of impact, or in regions at an angle $\alpha$ from the region of impact. The sequence and timing of the expression of fluid by the vents 26 and 32 is optimized to generate counter forces to dampen impact forces and thus protect the brain of any wearer of the helmet 10.

Figure 5:
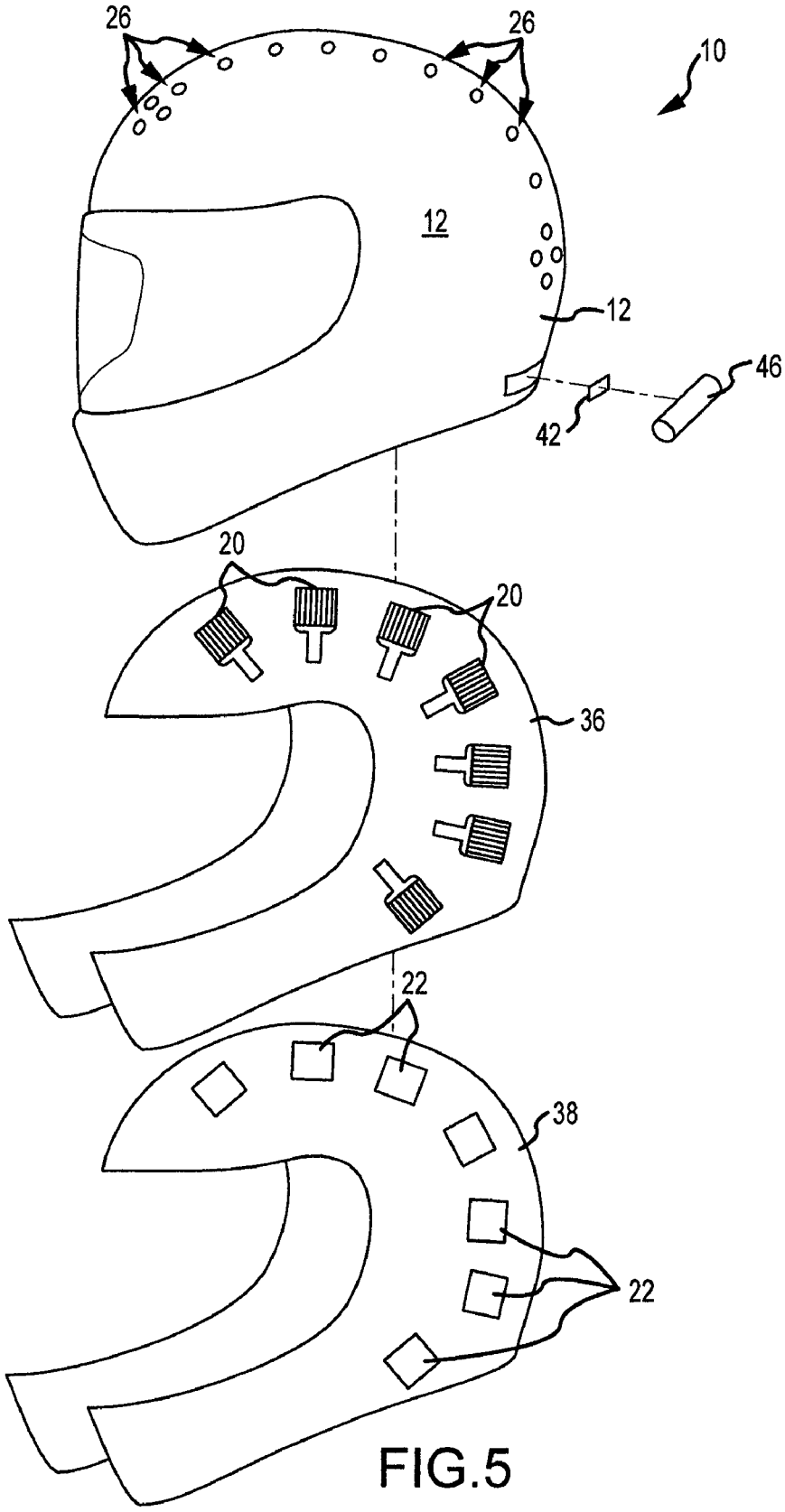
FIG. 5 shows an exploded perspective view of a motorcycle helmet.

FIG. 5 shows an exploded view of the helmet 10. The helmet 10 is a motorcycle helmet and includes a strain gauge layer 36 and a cell layer 38. The layers 36 and 38 may include a mesh or other semi-flexible material. In one embodiment, the layers 36 and 38 are moisture-resistant and have anti-microbial properties. The layers 36 and 38 stack within the shell 12 to hold the strain gauges 20 and the cells 22 in precise locations. Using the layers 36 and 38 enables easy replacement of the strain gauges 20 and the cells 22.

The layers 36 and 38 include fluid conduits defined between the cells and the vents 26 to enable the cells 22 to express fluid through the vents 26.

The vents 26 function, in addition to releasing fluid, to scatter and thus dampen forces (i.e. shockwaves) that move through the shell of the helmet 10.

While the present invention is illustrated in context of sports equipment and motor vehicle gear, it can be appreciated that the numerous helmet types that can employ the present invention are too numerous to illustrate in this document and that the motorcycle helmet and football helmet described herein are merely examples of how the present invention may be used, and are not intended to limit the scope of the present invention. For example, military helmets, lacrosse helmets, hard hats for construction jobs, and other helmets may be adapted for use with the present invention.

Figure 6:
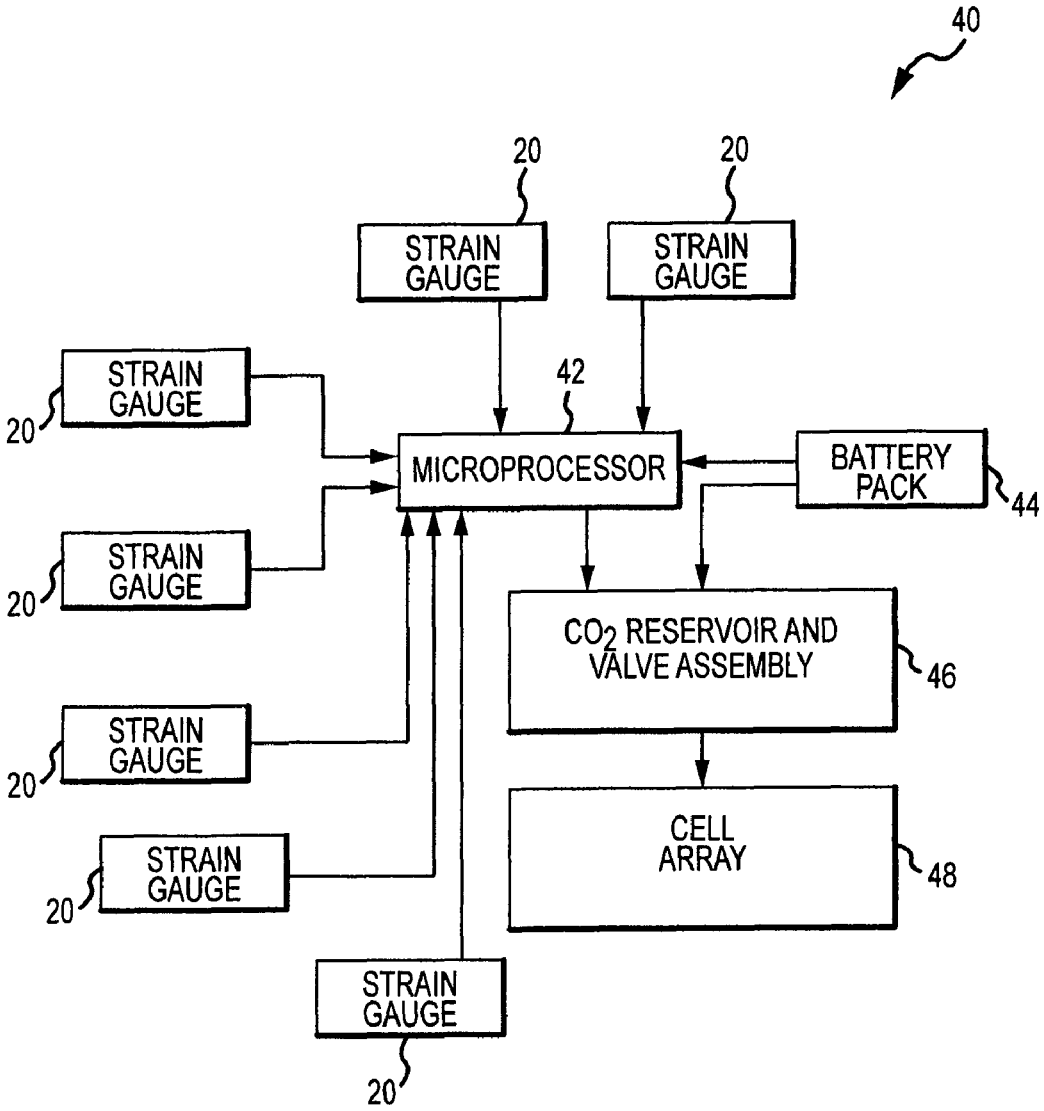
FIG. 6 shows a system diagram.

FIG. 6 shows a system 40 including a microprocessor, an array of strain gauges 20, a battery pack 44, a $CO_2$ Reservoir and Valve Assembly 46 and a cell array 48 of inflatable cells.

The strain gauges 20 are attached in communication with the microprocessor 42 to communicate any detected strain in the system 40. The battery pack 44 is electrically connected with the microprocessor to power the system 40. The $CO_2$ reservoir and valve assembly 46 are connected in communication with the microprocessor 42 to enable the microprocessor 42 to communicate instructions and data between the $CO_2$ reservoir and valve assembly 46 and the microprocessor 42.

Figure 7:
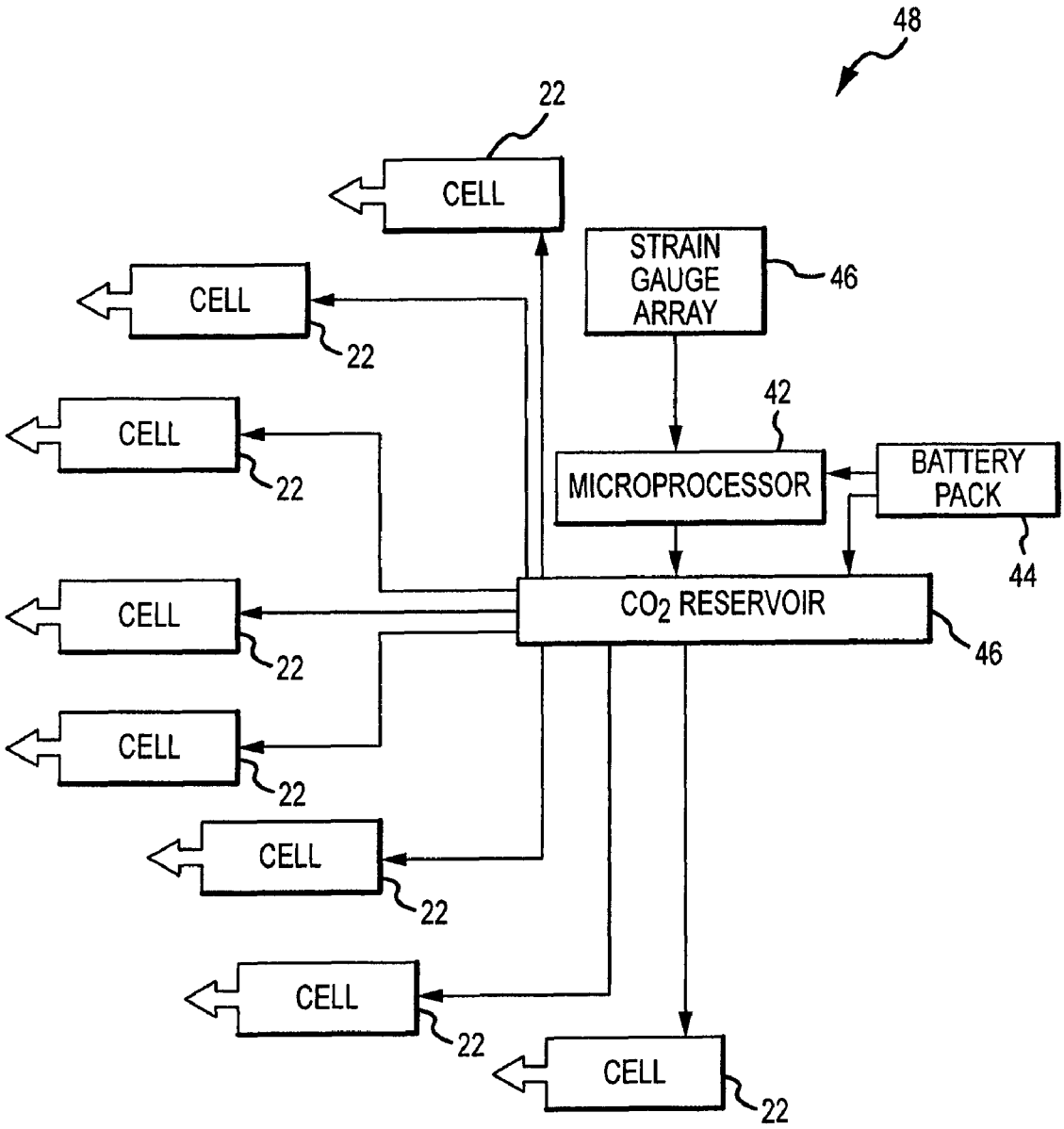
FIG. 7 shows a system diagram.

FIG. 7 shows the system 48 including a microprocessor 42, a battery pack 44, a strain gauge array 46, a $CO_2$ reservoir 46 and numerous cells 22. The $CO_2$ reservoir communicates fluid between the $CO_2$ reservoir 46 and each cell. Conduits, each having valves interconnect the $CO_2$ reservoir and the cells 22. The $CO_2$ reservoir pressurizes the conduits and the valves regulate pressure within the conduits and the cells 22. Particularly, the microprocessor 42 controls the valves between the $CO_2$ reservoir and the cells 22 to optimize pressure within the cells and to selectively and immediately pressurize individual cells in a way that optimizes protective capability of the helmet.

The battery pack 44 includes a lithium power supply with sufficient voltage to power the system. The lithium power supply is removable and rechargeable.

Ideally the cells 22 hold pressure for a fraction of a second and then release the pressure. This process repeats iteratively in response to communications directed to the microprocessor 42 from the strain gauge array 46. Machine learning and pre-programmed algorithms direct operation of the microprocessor, and thus the inflation and deflation of the cells is controlled.

The human brain is not a perfect sphere so the microprocessor 42 could be programmed to account for brain shape in optimizing operation of the helmet. Responsive forces are not necessarily applied to only one side of the helmet, but can be deployed in numerous locations, or regions, to optimize the protective capabilities of the system of the present invention.

The microprocessor 42 is of the 64 bit variety and includes an integrated analog to digital converter in systems having analog strain gauges. The signals are comprised of the magnitude of the force at the each cell 22 and the location of each cell 22. The microprocessor then sends a signal to the cells 22, or a valve corresponding with a particular cell 22, that are activated in a manner to counter the force of an external blow to the helmet.

The microprocessor 42 is programmable to regulate system pressure to yield a base pressure in each cell 22 when the cell is not activated. The microprocessor 42 is programmable also to dictate the rate at which a cell 22 is inflated, or deflated in response to impact. The microprocessor 42 also regulates the maximum cell pressure upon inflation, which may correspond to the system pressure. The number of inflation/deflation cycles is optimized by the microprocessor 42.

The present invention contemplates more than one cycle of inflation/deflation of cells to optimally protect the brain of a helmet user. In one embodiment three cycles are used. It can be appreciated that any number of cycles may be used depending on the nature of the impact force.

In one embodiment, the microprocessor 42 programming, strain gauge positioning and cell positioning are adapted particularly focus on certain regions of the helmet that correlate with areas of the brain most likely to cause concussion.

Figure 8:
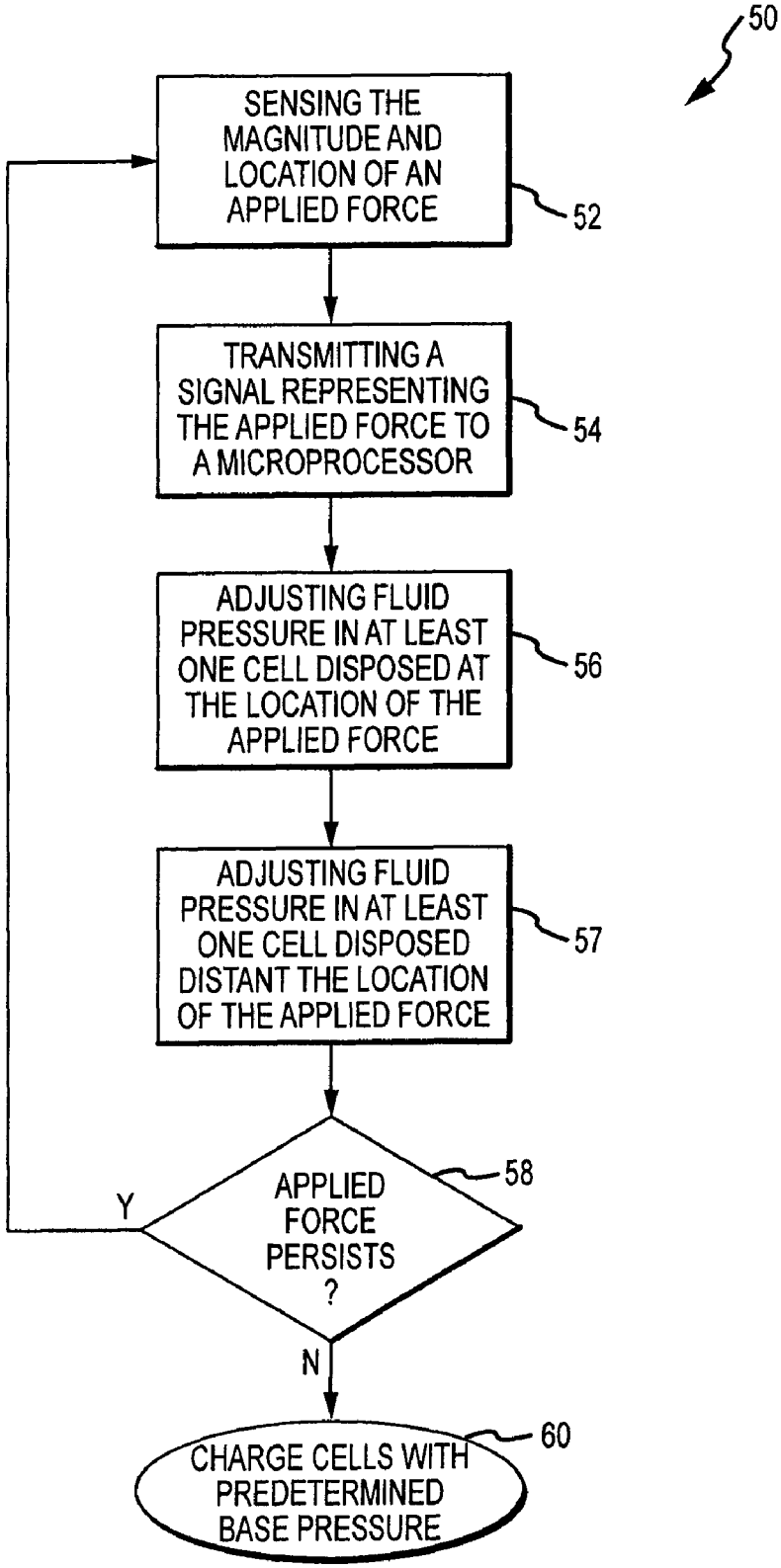
FIG. 8 shows a flow chart.

FIG. 8 is a flowchart 50 showing a method of using the system of the preset invention. The flowchart 50 includes the step 52 of sensing the magnitude and location of an applied force, the step 54 of transmitting a signal representing the applied force to a microprocessor, the step 56 includes adjusting fluid pressure in at least one cell disposed at the location of the applied force, the step 57 of adjusting fluid pressure in at least one cell disposed distant the location of the applied force the step 58 of deciding whether the applied force persists, and the step 60 charging cells with a pre-determined base pressure when the applied force does not persist. The process repeats with commencement of step 52 et seq. when the applied force persists.

The step 56 adjusting fluid pressure in at least one cell includes injecting a volume of fluid into the cell to adjust cell internal pressure. The step 56 also includes releasing fluid from the cell to adjust cell internal pressure. The volume of fluid injected or released into each cell depends on the amount of strain detected so that cells located nearer a high strain region of the helmet may maintain a different amount (or pressure) of fluid than cells located nearer a relatively lower strain region of the helmet. The volume of injected or released fluid is a function of fluid pressure and time. In one embodiment of the invention, the step 54 of transmitting a first signal includes determining when the magnitude of the impact meets a pre-determined threshold and inflating cells only after the pre-determined threshold is met. In particular, the cells maintain a base pressure, which is pre-determined.

In one embodiment of the invention, the step 54 of transmitting a first signal includes determining when the magnitude of the impact meets a pre-determined threshold and inflating cells only after the pre-determined threshold is met. In particular, the cells maintain a base pressure, which is pre-determined.

The step of transmitting a first signal 54, in one embodiment of the invention, includes predicting when the magnitude of an impact is likely to meet a pre-determined threshold and inflating cells after the prediction is made, and prior to the helmet fully receiving the impact. In this way, as soon as the beginning of an impact is detected, cells can be rapidly inflated then deflated, or simply deflated, in response to the strain. Inflation of cells may be accomplished sequentially or simultaneously.

Figure 9:
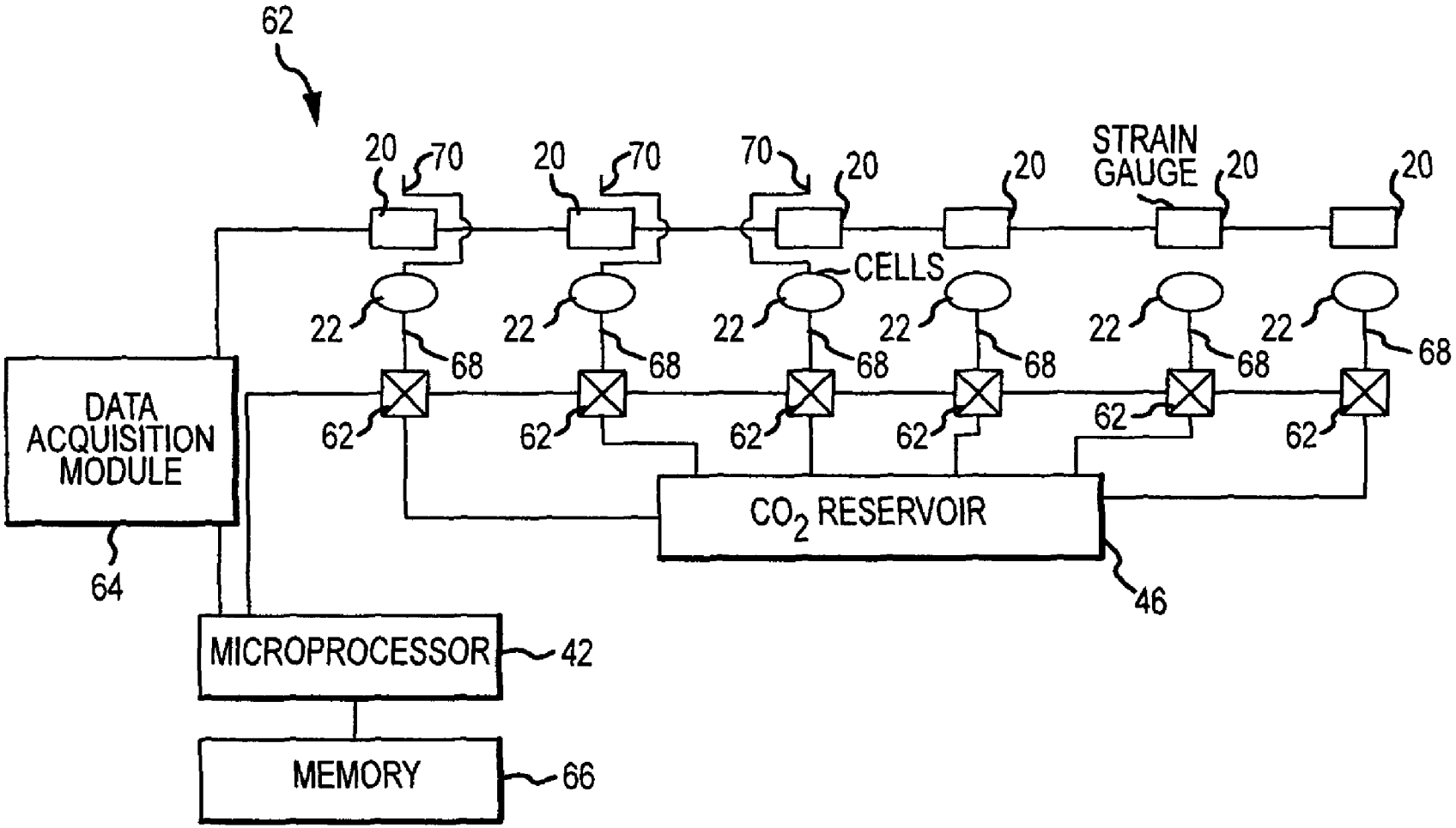
FIG. 9 shows a system diagram showing valves.

FIG. 9 shows a system 62 having a data acquisition module and system memory 66 in communication with the microprocessor 42. The system memory 66 is programmed with processor instructions to enable the microprocessor 42 to execute instructions and thereby optimize system performance.

The data acquisition module 64 interfaces between the microprocessor 42 and the strain gauges 20. In this embodiment of the invention, the strain gauges provide an analog signal that is transformed by the data acquisition module into digital signals for the microprocessor 42.

In an alternate embodiment the strain gauges 20 provide digital output directly to the microprocessor 42.

Strain gauge output includes a time component as well as a magnitude component. Each strain gauge location is stored in the memory 66 to enable the microprocessor 42 to interpret impact information and determine an optimal response to impact. Once an optimal response is determined, the microprocessor communicates instructions to the valves 62 to selectively inflate and deflate the cells 22, which provides a counter force that minimizes the biomechanical effects of the impact forces detected by the strain gauges 20. This process repeats until after impact forces are no longer detected within a threshold range. The threshold range being pre-determined and also stored in the memory 66.

The system 62 includes conduits 68 between the cells 22 and each corresponding valve 62. The system also includes conduits 70 that direct fluid from the cells 22 to corresponding vents 26 (FIG. 5) to enable expression of fluid from the cells to the atmosphere surrounding the system 62.

Figures 10A, 10B, 10C:
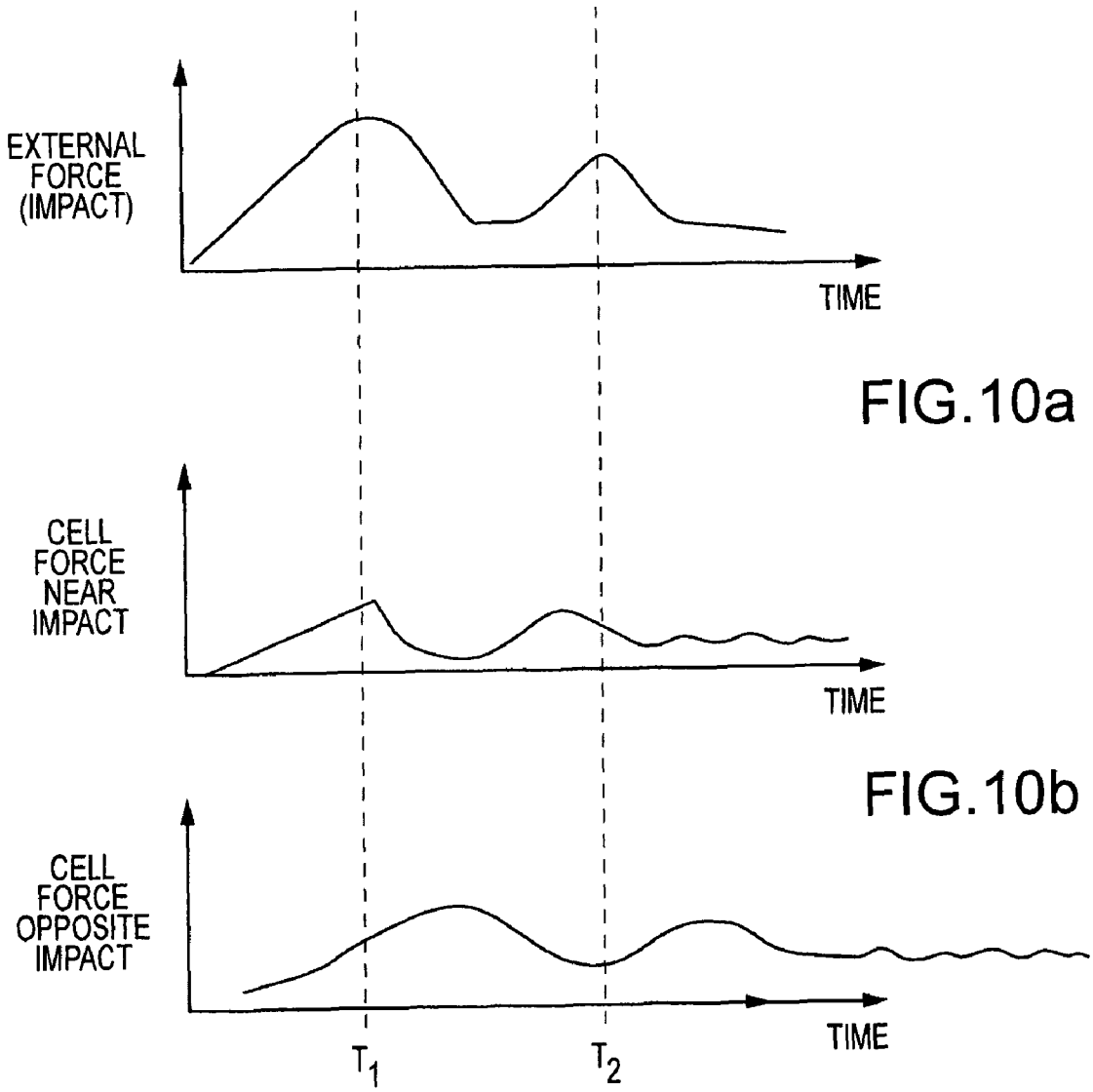
FIG. 10*a*-10*c* show charts of forces over time.

FIG. 10*a*-10*c* show a graph of impact force v. time for various stages of an impact. Initially, in FIG. 10*a* and a first impact is detected by the strain gauges. The impact is maximized at $T_1$ and a second impact is detected at $T_2$. FIG. 10*b* shows the systematic response to the impact shown in FIG. 10*a*. The response is generated by inflation of cells near the location of impact. The response, in one embodiment of the invention, includes inflating cells near the impact to generate a counter force at nearly the same time $T_1$ the impact force is maximized. The response occurs also at $T_2$. The responsive forces are less in magnitude than the impact forces.

FIG. 10*c* shows responsive forces generated by changing the internal pressure within cells located at a point or region distant from the impact force. Inflating cells at a position opposing the impact force, for example, counters reverberation of the helmet at a time later than the time for the responsive forces generated at $T_1$ and $T_2$, respectively.

While the present invention is described in terms of various embodiments, and exemplary drawings and attendant descriptions are provided, it should be understood that the descriptions and drawings provide only practical examples of the nature of the invention. For example, while carbon dioxide gas is used, various other fluids having predictable hydraulic properties may be employed by the present invention. The actual scope of the invention is defined by the appended claims.

What is claimed is:

1. A method for reducing concussive effects to the brain of a helmet user produced by impact on a protective helmet comprising:

sensing the magnitude and location of the impact;

transmitting a first signal to the location of the impact;

in response to the first signal, adjusting fluid pressure in at least one cell disposed between the helmet and the head of a user;

transmitting a second signal to a location on the helmet distant to the location of the impact; and in response to the second signal, adjusting fluid pressure in at least one cell disposed between the protective helmet and the head of the helmet wearer at the location distant to the impact.

2. The method of claim 1 wherein the fluid pressure is adjusted by storing and delivering carbon dioxide gas.

3. The method of claim 1 further comprising:

transmitting a third signal to the location of the applied force;

responsive to the transmitted third signal, adjusting fluid pressure in at least one cell disposed between the outside surface of the protective head helmet and the head of the helmet wearer at the location of the applied force.

4. The method of claim 1, wherein the step of sensing the magnitude and location of the impact includes simultaneously detecting strain with an array of strain gauges which communicate strain measurements to a microprocessor mounted in the helmet.

5. The method of claim 4, wherein the step of transmitting a first signal includes transmitting a signal to cells near the impact location to enable injection of fluid into the cells.

6. The method of claim 5 further comprising injecting fluid into the cells near the impact location, wherein the volume of fluid injected into each cell depends on the amount of strain detected so that cells located nearer a high strain region of the helmet will receive more fluid than cells located nearer a relatively lower strain region of the helmet.

7. The method of claim 1, wherein the step of transmitting a first signal includes determining when the magnitude of the impact meets a pre-determined threshold and inflating cells only after the pre-determined threshold is met.

8. The method of claim 7, wherein the step of transmitting a first signal includes predicting when the magnitude of an impact is likely to meet a pre-determined threshold and inflating cells after the prediction is made, and prior to the helmet fully receiving the impact.

9. A system for reducing the concussive effects of impact, comprising:

a helmet for protecting the head of a user, the helmet having a plurality of vents to permit air flow and to dampen impact forces;

an array of strain gauges attached within the helmet for detecting a strain profile resulting from impact;

an array of inflatable cells attached within the helmet, the cells being selectively inflatable for re-directing impact forces, each cell has a fluid conduit and a valve for inflating and deflating each cell; and a microprocessor connected in operative communication with the array of strain gauges and with the valves;

whereby when impact is detected by the strain gauges and communicated to the microprocessor, the microprocessor selectively signals at least some of the valves to adjust pressure in the cells.

10. A system as set forth in claim 9, wherein the microprocessor determines an optimal impulse profile responsive to impact and causes the valves to inflate selected cells to match the optimal impulse profile.

11. A system as set forth in claim 9, wherein upon detection of an impact, the microprocessor causes the valves to immediately inflate cells located near the impact.

12. A system as set forth in claim 9, wherein upon detection of an impact, the microprocessor causes the valves to immediately deflate cells located near the impact and after a predetermined delay period causes the valves to adjust pressure of cells at a location distant from the impact.

13. A helmet for reducing the concussive effects of an impact, comprising:

a protective shell having an inner surface;

an array of strain gauges attached to the shell for detecting an impact;

an array of cells attached within the helmet, each cell being selectively inflatable for generating responsive forces to counter the impact;

a fluid reservoir attached to the helmet;

a fluid conduit including a valve, the fluid conduit being attached in fluid communication between the fluid reservoir and cells for inflating and deflating each cell with fluid; and a microprocessor connected in operative communication with the array of strain gauges and with the valves;

whereby, when the system detects impact the microprocessor sequentially signals at least some of the valves to adjust pressure in the cells.

14. A helmet as set forth in claim 13, wherein when the system detects impact the microprocessor sequentially signals at least some of the valves to rapidly inflate the cells.

15. A helmet as set forth in claim 14, wherein the valves release fluid after inflation to cushion the head of a user.

16. A helmet as set forth in claim 14, wherein the valves automatically release fluid when cell pressure exceeds a predetermined base pressure.

17. A helmet as set forth in claim 13, wherein the strain gauges detect strain and communicate with the microprocessor during an impact to enable to microprocessor to signal the valves to inflate selected cells during the impact.

18. A helmet as set forth in claim 13, wherein the fluid conduits and the valves cooperate to release fluid from inflated cells after the impact.

19. A helmet as set forth in claim 13, wherein the fluid is carbon dioxide gas.

20. A helmet as set forth in claim 19, wherein the shell includes at least one vent in fluid communication with the cells for releasing carbon dioxide gas from the cells to outside of the helmet.

* * * * *